US012055073B2

(12) United States Patent
Weber

(10) Patent No.: US 12,055,073 B2
(45) Date of Patent: Aug. 6, 2024

(54) BYPASS OIL SUPPLY FOR AN OIL VOLUME ACCUMULATOR OF A HYDRAULIC CAMSHAFT PHASER

(71) Applicant: Schaeffler Technologies AG & Co. KG, Herzogenaurach (DE)

(72) Inventor: Juergen Weber, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 18/265,534

(22) PCT Filed: Nov. 19, 2021

(86) PCT No.: PCT/DE2021/100920
§ 371 (c)(1),
(2) Date: Jun. 6, 2023

(87) PCT Pub. No.: WO2022/122073
PCT Pub. Date: Jun. 16, 2022

(65) Prior Publication Data

US 2024/0026804 A1 Jan. 25, 2024

(30) Foreign Application Priority Data

Dec. 7, 2020 (DE) ..... 10 2020 132 428.6

(51) Int. Cl.
*F01L 1/344* (2006.01)

(52) U.S. Cl.
CPC ... *F01L 1/3442* (2013.01); *F01L 2001/34426* (2013.01); *F01L 2001/34446* (2013.01); *F01L 2001/34479* (2013.01)

(58) Field of Classification Search
CPC ..... F01L 1/3442; F01L 2001/34446
See application file for complete search history.

(56) References Cited

U.S. PATENT DOCUMENTS

2020/0095906 A1 3/2020 Mlinaric

FOREIGN PATENT DOCUMENTS

| | | | | |
|---|---|---|---|---|
| DE | 102009042202 A1 | 4/2011 | | |
| DE | 102010019530 A1 | 11/2011 | | |
| DE | 102012201553 A1 | 8/2013 | | |
| DE | 102012201559 A1 | 8/2013 | | |
| DE | 102012201566 B4 | 5/2017 | | |
| DE | 102016218793 A1 | 6/2017 | | |
| DE | 102017111737 A1 | 3/2018 | | |
| DE | 102017113361 B3 | 9/2018 | | |
| DE | 102019123520 A1 | 6/2020 | | |
| WO | WO-2011032805 A1 * | 3/2011 | ..... | F01L 1/344 |

* cited by examiner

*Primary Examiner* — Ngoc T Nguyen

(57) ABSTRACT

The disclosure relates to a hydraulic camshaft phaser for relative rotation between a camshaft and a crankshaft. The camshaft phaser comprising two oppositely acting working chambers to which hydraulic medium pressure can be applied in a controlling manner by means of a hydraulic valve, thereby causing a relative rotation between the camshaft and the crankshaft. A volume accumulator formed by the camshaft phaser collects the hydraulic medium exiting from the working chambers. The volume accumulator is divided into two partial volume accumulators which flank the working chambers in an axial direction and which are connected to one another by a hydraulic medium line which extends axially through the camshaft phaser and is independent of the working chambers.

20 Claims, 1 Drawing Sheet

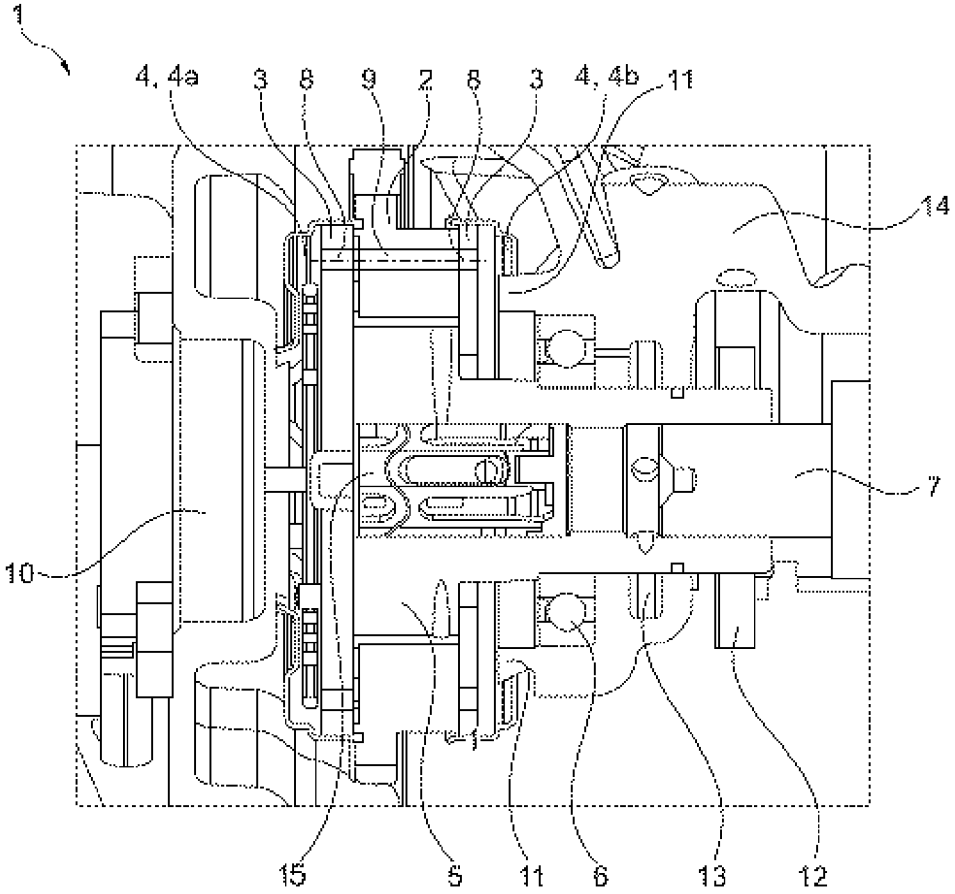
1
4, 4a
3
8
9
2
8
3
4, 4b
11
14
7
10
15
5
11
6
13
12

BYPASS OIL SUPPLY FOR AN OIL VOLUME ACCUMULATOR OF A HYDRAULIC CAMSHAFT PHASER

CROSS-REFERENCE TO RELATED APPLICATIONS

This application is the U.S. National Phase of PCT Application No. PCT/DE2021/100920 filed on Nov. 19, 2021, which claims priority to DE 10 2020 132 428.6 filed on Dec. 7, 2020, the entire disclosures of which are incorporated by reference herein.

TECHNICAL FIELD

The disclosure relates to a hydraulic camshaft phaser for an internal combustion engine.

BACKGROUND

Camshaft phasers are used in internal combustion engines to vary the control times of the combustion chamber valves to enable a variable design of the phase relationship between a crankshaft and a camshaft within a defined angular range, between a maximum early and a maximum late position. Adjusting the control times to the current load and rotational speed reduces fuel consumption and emissions. For this purpose, camshaft phasers are integrated into a drive train, via which torque is transmitted from the crankshaft to the camshaft. This drive train can be designed, for example, as a belt drive, chain drive, or gear drive.

In the case of a hydraulic camshaft phaser, the output element and the drive element form one or more pairs of pressure chambers which act oppositely to one another and to which hydraulic medium can be applied. The drive element and the output element are arranged to be coaxial. The filling and emptying of individual pressure chambers creates a relative movement between the drive element and the output element. The spring, which acts rotationally between the drive element and the output element, pushes the drive element in an advantageous direction with respect to the output element. This advantageous direction can be the same or opposite to the direction of rotation.

One type of hydraulic camshaft phaser is the vane cell adjuster. The vane cell adjuster has a stator, a rotor, and a drive wheel having external teeth. The rotor is usually designed as an output element so that it can be connected in a rotationally fixed manner to the camshaft. The drive element includes the stator and the drive wheel. The stator and the drive wheel are connected to one another in a rotationally fixed manner or alternatively are formed in one piece with one another. The rotor is arranged to be coaxial to the stator and inside the stator. The rotor and the stator, having the radially extending vanes thereof, form oppositely acting oil chambers to which oil pressure can be applied and enable a relative rotation between the stator and the rotor. The vanes are either formed in one piece with the rotor or the stator or are arranged as "inserted vanes" In grooves provided for this purpose in the rotor or the stator. The vane cell adjusters also have various sealing covers. The stator and the sealing cover are secured together using several screw connections.

Another type of hydraulic camshaft phaser is the axial piston adjuster. Here, a displacement element is axially displaced via oil pressure, which generates a relative rotation between a drive element and an output element via helical toothing.

Another design of a camshaft phaser is the electromechanical camshaft phaser, which has a triple-shaft gear (for example a planetary gear or a shaft drive). One of the shafts forms the drive element and a second shaft forms the output element. Rotational energy can be supplied to the system via the third shaft by means of an actuating device, for example an electric motor or a brake, or can be removed from the system to initiate an adjustment. A spring can also be arranged which supports or returns the relative rotation between the drive element and the output element.

DE 10 2009 042 202 A1 shows a device for variably adjusting the control times of gas exchange valves of an internal combustion engine with a hydraulic phase adjustment device and at least one volume accumulator, wherein the phase adjustment device is drive-connectable to a crankshaft and a camshaft and has at least one early adjustment chamber and at least one late adjustment chamber, to which pressure medium can be supplied or discharged via pressure medium lines, wherein a phase position of the camshaft relative to the crankshaft can be adjusted in the direction of earlier control times by supplying pressure medium to the early adjustment chamber with simultaneous pressure medium discharge from the late adjustment chamber, wherein a phase position of the camshaft relative to the crankshaft can be adjusted in the direction of later control times by the early adjustment chamber through pressure medium being supplied to the late adjustment chamber with simultaneous pressure medium discharge, wherein pressure medium can be supplied to the one or more volume accumulators during operation of the internal combustion engine.

DE 10 2010 019 530 A1 shows a camshaft phaser of vane cell design having a stator and a rotor that can be rotated relative to the stator, and at least two pressure chambers formed between the stator and the rotor which are separated from one another by a radially oriented vane of the rotor, wherein a pressure medium can be supplied alternately to the pressure chambers, wherein the vane has a radial surface and two side surfaces directed towards the pressure chambers, and wherein the radial surface is sealed by a U-shaped sealing element having a base leg and two side legs resting on the side faces.

Non-return valves are formed on the side legs and outlets for the pressure medium are formed on the side surfaces of the vane to which the non-return valves are assigned. In this case, a volume accumulator for the pressure medium is formed in particular in the rotor so that this arrangement of the volume accumulator maintains the pressure build-up when the camshaft phaser is adjusted. From there, the oil is introduced into the interior of the vane via the pressure medium channels and then fed into one of the chambers via an outlet on the corresponding side surface of the vane if the chamber is under negative pressure with respect to the volume accumulator.

SUMMARY

The object of the disclosure is to provide a camshaft adjusting device which has an improved oil supply.

According to the disclosure, this object is achieved by the features described herein.

This ensures that hydraulic medium can be collected from other sources, as a result of which the volume accumulator fills up more quickly. This further reduces the introduction of air in the after-suction process of a working chamber. The division into two partial volume accumulators that can be filled via a separate line also brings advantages when filling the entire volume accumulator. If the volume accumulator is filled from several sources, each partial volume accumulator can be geometrically adapted to the corresponding type of filling. In other words, the type of filling determines the shape of the inflow behavior of the hydraulic medium into the partial volume accumulator. In addition, filling can take place in various operating states of the camshaft phaser or camshaft adjusting device, which would otherwise only be tied to a single source—with the associated advantages and disadvantages. It is now possible by means of the compromise to achieve a better capacity to be refilled and to operate the camshaft phaser more reliably over a broad performance profile.

The hydraulic medium in the volume accumulator is suctioned in by a working chamber during an adjustment process, since a vacuum peak can occur in the working chamber to be enlarged during an adjustment process due to alternating camshaft torques. In this short time interval, this vacuum peak opens a non-return valve, which is arranged between the working chamber and the volume accumulator, after which the hydraulic medium stored in the volume accumulator can flow into the working chamber and can compensate for the lack of supply occurring due to the vacuum peak. As a result, less air can enter the working chamber since the hydraulic medium is suctioned in from the volume accumulator. For this purpose it is advantageous that the openings of the hydraulic medium lines to the volume accumulator are covered with a filling level of hydraulic medium.

The hydraulic medium line extending axially through the camshaft phaser can be patterned and multiplied over the circumference.

In one embodiment of the disclosure, one partial volume accumulator is connected to a tank connection of the hydraulic valve and can be filled thereby, and the other partial volume accumulator can be filled with leakage oil as the hydraulic medium exiting from the camshaft phaser. Advantageously, the exiting leakage oil is recycled for the adjustment process instead of being returned to the tank.

In an example embodiment, one partial volume accumulator fills the other partial volume accumulator in the manner of a cascade. This offers advantages in that one partial volume accumulator can be filled first and the other partial volume accumulator is filled after the fill level has been reached. For this purpose, one partial volume accumulator has an overflow, which is used after a specific fill level in one partial volume accumulator to fill the other partial volume accumulator. This can be further optimized with the pattern and arrangement of the hydraulic medium line, which extends axially through the camshaft phaser and connects the two partial volume accumulators to one another.

In an example embodiment, a camshaft phaser device having a hydraulic camshaft phaser and a camshaft has a radial bearing of the camshaft phaser device that is adjacent to a partial volume accumulator and is designed as a roller bearing. This radial bearing is in turn adjacent to the transfer point of the P line, which conducts the pressurized hydraulic medium to the control valve of the camshaft phaser, to the camshaft or camshaft phaser.

In an embodiment of the camshaft phaser device according to the disclosure, a partial volume accumulator can be filled with hydraulic fluid exiting from the radial bearing. A hydraulic medium exiting from the radial bearing can thus be supplied to the partial volume accumulator and does not need to be routed to the tank.

BRIEF DESCRIPTION OF THE DRAWINGS

An exemplary embodiment of the disclosure is shown in the FIGURE.

In the FIGURE:

FIG. 1 shows a camshaft phaser device having a camshaft phaser according to the disclosure.

DETAILED DESCRIPTION

FIG. 1 shows a camshaft phaser device 1 having a camshaft phaser 2 according to the disclosure.

The camshaft phaser 2 has a drive element with teeth and an output element 5 which can be rotated relative to one another. The rotatability is realized—as known from the prior art—by working chambers formed between these two elements and acting oppositely, which are controlled by a control valve 15 that is actuated by a central magnet 10. The output element 5 is flanked and enclosed by two sealing covers 3 in the axial direction. A partial volume accumulator 4*a*, 4*b* in the form of a cover sits on each side of these sealing covers 3. So that the two partial volume accumulators 4*a* and 4*b* can communicate with one another hydraulically, a hydraulic medium line is formed from the sealing covers 3 and the drive element. The hydraulic medium line has bores 9 in the drive element and bores 8 arranged to be coaxial thereto in the respective sealing cover 3, so that an exchange or transfer from one partial volume accumulator 4*a* to the other partial volume accumulator 4*b* can take place.

The output element 5 has an extension which extends centrally in the axial direction and into which one end of the camshaft 7 engages in a rotationally fixed manner. The radial bearing 6 in the form of a roller bearing and the trigger wheel 12 are seated on the outer peripheral surface of the extension. The extension has radial bores, which are placed axially between the radial bearing 6 and the trigger wheel 12, which can lead the hydraulic medium from the P line 13 to the control valve 15 designed as a central valve. This P line is in fluidic communication with the radial bearing 6, as a result of which the radial bearing 6 can also be lubricated with a partial volume flow from the P line 13 during operation. If such a partial volume flow penetrates the radial bearing 6 in the axial direction, this partial volume flow hits the sealing cover 3 of the camshaft phaser 2 and can be collected by the partial volume accumulator 4*b*. Hydraulic medium collected in the partial volume accumulator 4*b* is then available to the working chamber in the event of a vacuum peak.

LIST OF REFERENCE SYMBOLS

1 Camshaft phaser device
2 Hydraulic camshaft phaser
3 Sealing cover
4 Volume accumulator
4*a* Partial volume accumulator
4*b* Partial volume accumulator
5 Rotor
6 Radial bearing/radial bearing
7 Camshaft
8 Hydraulic medium line
9 Hydraulic medium line
10 Central magnet
11 Extension
12 Trigger wheel
13 Oil supply (P line)
14 Cylinder head
15 Control valve

The invention claimed is:

1. A hydraulic camshaft phaser configured to adjust relative rotation between a camshaft and a crankshaft, comprising:

two oppositely acting working chambers to which hydraulic medium pressure can be controllably applied via a hydraulic valve, thereby causing a relative rotation between the camshaft and the crankshaft, a volume accumulator formed by the hydraulic camshaft phaser, the volume accumulator configured to collect hydraulic medium, and the volume accumulator is divided into two partial volume accumulators; i) arranged to flank the two oppositely acting working chambers in an axial direction, and ii) connected to one another by a hydraulic medium line extending axially through the hydraulic camshaft phaser and independent of the two oppositely acting working chambers.

2. The hydraulic camshaft phaser according to claim 1, wherein:

a first one of the two partial volume accumulators is connected to a tank connection of the hydraulic valve and can be filled by the hydraulic valve, and a second one of the two partial volume accumulators can be filled with leakage oil exiting the hydraulic camshaft phaser.

3. The hydraulic camshaft phaser according to claim 1, wherein either a first one or a second one of the two partial volume accumulators is configured to fill a remaining one of the two partial volume accumulators.

4. A camshaft phaser device having the hydraulic camshaft phaser according to claim 1, the camshaft phaser device comprising a radial bearing arranged adjacent to one of the two partial volume accumulators and configured as a roller bearing.

5. The camshaft phaser device according to claim 4, wherein the one of the two partial volume accumulators can be filled with hydraulic medium exiting from the radial bearing.

6. The hydraulic camshaft phaser according to claim 1, wherein either a first one or a second one of the two partial volume accumulators fills a remaining one of the two partial volume accumulators after the first one or the second one of the two partial volume accumulators is filled.

7. The hydraulic camshaft phaser according to claim 1, further comprising a drive element configured to form a portion of the two oppositely acting working chambers, and the hydraulic medium line extends through the drive element.

8. The hydraulic camshaft phaser according to claim 1, further comprising:

an output element configured to form a portion of the two oppositely acting working chambers, the output element flanked by a first sealing cover and a second sealing cover, and the hydraulic medium line extends through the first sealing cover and the second sealing cover.

9. The hydraulic camshaft phaser according to claim 8, wherein a first one of the two partial volume accumulators is arranged on the first sealing cover, and a second one of two partial volume accumulators is arranged on the second sealing cover.

10. A hydraulic camshaft phaser configured to adjust relative rotation between a camshaft and a crankshaft, comprising:

working chambers to which hydraulic medium pressure can be controllably applied via a hydraulic valve, thereby causing a relative rotation between the camshaft and the crankshaft, the working chambers formed by a drive element and an output element, a volume accumulator formed by the hydraulic camshaft phaser, the volume accumulator configured to collect hydraulic medium, and the volume accumulator is divided into two partial volume accumulators: i) arranged at each axial end of the hydraulic camshaft phaser, and ii) connected to one another by a hydraulic medium line extending axially through the drive element independent of the working chambers.

11. The hydraulic camshaft phaser according to claim 10, further comprising a central magnet configured to actuate the hydraulic valve.

12. The hydraulic camshaft phaser according to claim 11, wherein a first one of the two partial volume accumulators is arranged between the central magnet and the drive element in an axial direction.

13. The hydraulic camshaft phaser of claim 12, further comprising a roller bearing, and a second one of the two partial volume accumulators is arranged between the roller bearing and the drive element in the axial direction.

14. The hydraulic camshaft phaser of claim 13, wherein the hydraulic valve is fluidly connected to the roller bearing.

15. The hydraulic camshaft phaser according to claim 13, wherein the second one of the two partial volume accumulators is configured to receive hydraulic medium exiting from the roller bearing.

16. The hydraulic camshaft phaser according to claim 10, further comprising a first sealing cover and a second sealing cover configured to flank the output element, and the hydraulic medium line extends through the first sealing cover and the second sealing cover.

17. The hydraulic camshaft phaser according to claim 16, wherein a first one of the two partial volume accumulators is arranged on the first sealing cover, and a second one of the two partial volume accumulators is arranged on the second sealing cover.

18. The hydraulic camshaft phaser according to claim 10, wherein the drive element and the output element are coaxially arranged.

19. The hydraulic camshaft phaser according to claim 18, wherein the drive element is arranged radially outwardly of the output element.

20. The hydraulic camshaft phaser according to claim 10, wherein the output element is configured to be rotationally fixed to the camshaft.

* * * * *